United States Patent [19]

Jungermann et al.

[11] Patent Number: 4,758,370

[45] Date of Patent: Jul. 19, 1988

[54] COMPOSITIONS AND PROCESSES FOR THE CONTINUOUS PRODUCTION OF TRANSPARENT SOAP

[75] Inventors: Eric Jungermann, Phoenix, Ariz.; Thomas Hassapis, Huntington Beach, Calif.; Richard A. Scott, Burbank, Calif.; Mitchell S. Wortzman, Los Angeles, Calif.

[73] Assignee: Neutrogena Corp., Los Angeles, Calif.

[21] Appl. No.: 44,221

[22] Filed: Apr. 30, 1987

[51] Int. Cl.[4] ..... C11D 13/14

[52] U.S. Cl. ..... 252/132; 252/108; 252/134; 252/369; 252/370; 252/DIG. 16

[58] Field of Search ..... 252/369, 108, DIG. 16, 252/134, 132, 370; 422/129.1; 260/416, 417

[56] References Cited

U.S. PATENT DOCUMENTS

| | | | |
|---|---|---|---|
| 2,484,098 | 10/1949 | Knoll | 252/368 |
| 3,789,011 | 1/1974 | Tanaka | 252/367 |
| 4,165,293 | 8/1979 | Gordon | 252/118 |
| 4,328,131 | 5/1982 | Carson | 252/542 |
| 4,474,683 | 10/1984 | Story | 252/369 |
| 4,493,786 | 1/1985 | Joshi | 252/368 |

FOREIGN PATENT DOCUMENTS 1026699A 2/1986 Japan .

*Primary Examiner*—Paul Lieberman
*Assistant Examiner*—Isabelle Rodriquez
*Attorney, Agent, or Firm*—Richard R. Mybeck

[57] ABSTRACT

Compositions and processes for the continuous production of transparent soap which provides an enhanced product and at a lower unit cost than heretofore obtainable. Stoichiometrically balanced blends are passed through a series of preheated mixing tanks into molds which are thereafter chilled to solidify the individual bars.

8 Claims, 1 Drawing Sheet

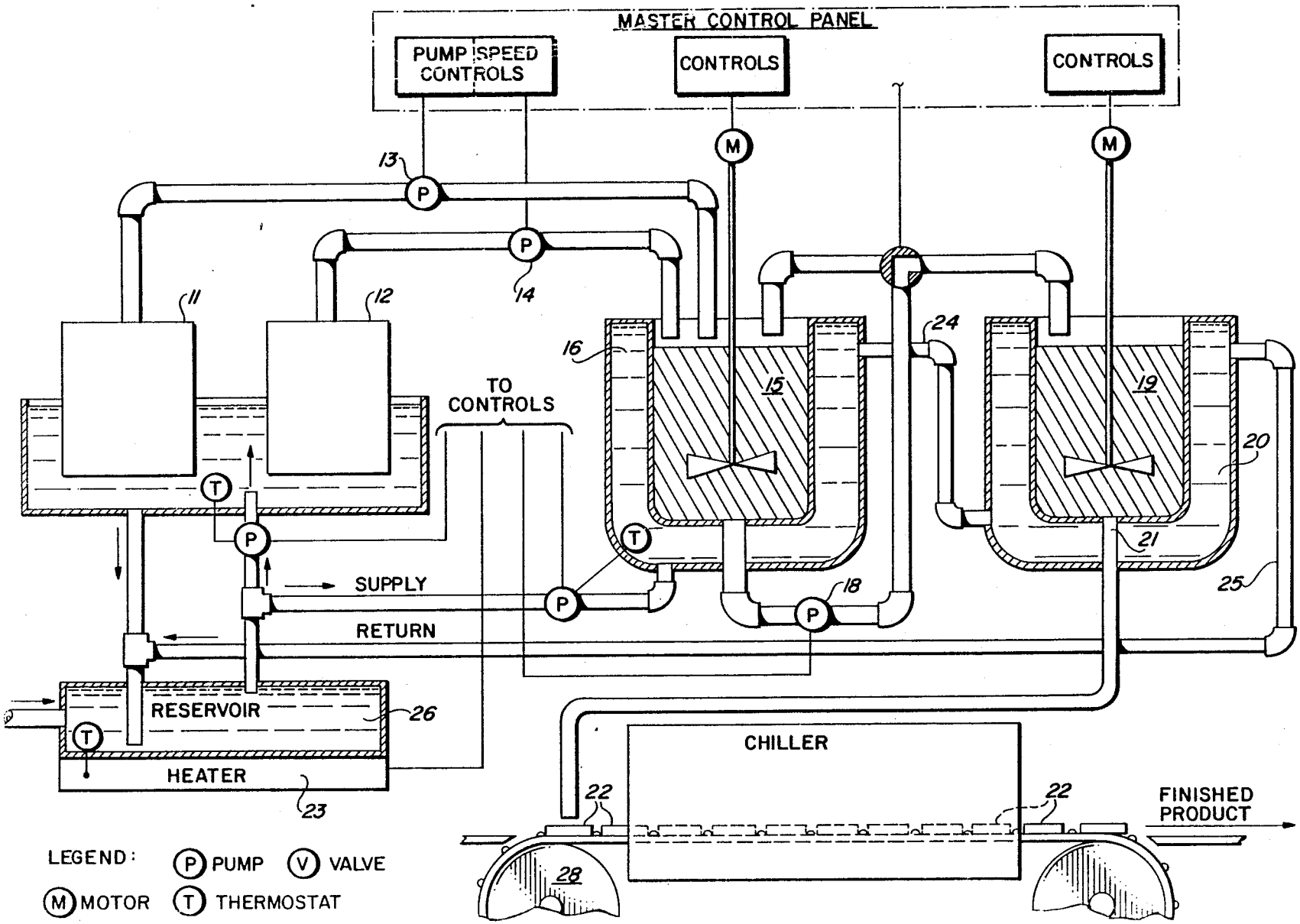
MASTER CONTROL PANEL
CONTROLS
CONTROLS
PUMP SPEED CONTROLS
FINISHED PRODUCT
CHILLER
TO CONTROLS
SUPPLY
RETURN
RESERVOIR
HEATER
LEGEND:
P PUMP
V VALVE
M MOTOR
T THERMOSTAT

COMPOSITIONS AND PROCESSES FOR THE CONTINUOUS PRODUCTION OF TRANSPARENT SOAP

INTRODUCTION

The present invention relates to soap and more particularly to new and improved compositions and processes for the continuous production of transparent soap.

BACKGROUND OF THE ART

The basic reactions in soapmaking are quite simple. They either consist of reacting fat with an alkali to produce soap and glycerine, or to neutralize fatty acids with an alkali. On the other hand, the technology of soapmaking is quite involved, and practical soapmaking borders at times on an art because of the complex physical nature of soap and its aqueous systems. Saponification of fats is in itself an exacting operation and is illustrated by Equation 1, below:

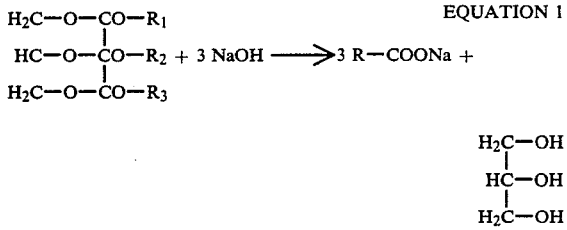

EQUATION 1 wherein $R_1$ represents saturated, unsaturated, polyunsaturated, or branched aliphatic chains having C=7–19;

$R_2$ represents saturated, unsaturated, polyunsaturated, or branched aliphatic chains having C=7–19;

$R_3$ represents saturated, unsaturated, polyunsaturated, or branched aliphatic chains having C=7–19; and R represents a mixture of $R_1$, $R_2$ and $R_3$.

In this process, the soap, after saponification, is usually carried through a series of phase changes for the removal of impurities, the recovery of glycerine, and reduction of the moisture content to a relatively low level. The complex series of operations in the production of an ordinary full-boiled or settled soap is as follows: (a) reaction of the fat with alkali until it is largely saponified, (b) graining out of the soap from solution with salt in two or more stages for recovery of the glycerol produced by the reaction; (c) boiling of the material with an excess of alkali to complete saponification, followed by graining out with alkali; and (d) separation of the batch into immiscible phases of neat soap and niger, the so-called "fitting" operation. The final result is "neat" soap with a composition ranging from 60–65% soap and about 35–40% water, plus small amounts of salt and glycerine.

When fatty acids are used as the starting material, reaction with alkali is a conventional neutralization as shown in equation 2.

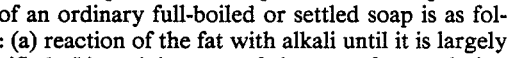

EQUATION 2.

The fatty acids are usually obtained by splitting fats into fatty acids and glycerol using high pressure steam with and without the use of a catalyst. (*Bailey's Industrial Oil and Fat Products,* 4th Edition, Volume 1, Chapter 8, pp 99–103, John Wiley and Sons Inc., 1979.) This is followed by distillation of the crude fatty acids and neutralization of the distilled fatty acids. Selection of the proper concentration of alkali will result in the production of neat soap described above. For the production of non transparent and certain translucent soaps, the neat soap is then dried to a moisture content of 12–15%.

A breakthrough from the traditional soap-boiling processes was the advent of various continuous saponification processes which emerged after World War II. These processes fell into two main categories: those based on the continuous saponification of fats, i.e., the DeLaval, the Sharples, Mechaniche Moderne, and the Mazzoni SCN-LR processes; and those based on the continuous splitting of fats into fatty acids followed by distillation and neutralization. Typical examples are the Mazzoni SC and the Armour-Dial processes. A more complete description of these processes appears in Bailey's (Ibid, pp. 535–549), and will not be repeated here.

In spite of the development of continuous soapmaking processes, industry has heretofore been unable to adapt any of these processes to the efficient and economical production of high quality transparent soaps. Transparent soaps are traditionally prepared by the semi-boiled or by the "cold process", utilizing special fat blends. (Bailey's, Ibid, pg. 534.) They often contain additives such as sugar, glycerol, alcohol, triethanolamine and rosins. They are poured into frames, held at room temperature for periods of time, and thereafter cut into bars.

Processes for the manufacture of transparent soaps have been known for a long time, the oldest recorded product being "Pears Transparent Soap" which was first offered for sale in England in 1789.

As a point of reference, "transparent soap", as that term is used herein encompasses soaps having a wide degree of color and gloss but which are sufficiently transparent so that one with normal vision can effectively see through a toilet sized bar. Specifically, if 14 point type can be seen through a ¼ inch thick bar of soap, that bar of soap is defined as "transparent". (Wells, F. M., *Soap and Cosmetic Specialties,* 31 (6–7) June-July, 1955.)

Because regular and transparent soaps traditionally have a pH of 10 or higher, and many transparent soaps often contained alcohol, they acquired a reputation of causing skin dryness. Fromont (U.S. Pat. No. 2,820,768) addressed this issue with a less alkaline transparent soap free of alcohol and based on a blend of sodium and triethanolamine soaps from tallow, coconut oil and castor oil and "superfatted" with fatty acids such as stearic acid and oleic acid. Soap manufactured under this patent was marketed under the trade name Neutrogena® and found to be exceptionally mild. The mildness of this formula has been demonstrated using the Soap Chamber Test. (Frosch, P. J. and Kligman, A. M.: *The Soap Chamber Test.* J. American Academy Dermatology, 1:35, 1979 and Dyer, D. and Hassapis, T. *Comparison of Detergent Based Versus Soap Based Liquid Soap.* Soap Cosmetic and Chemical Specialties. July, 1983). In this test, an 8% soap solution is applied to the arms of volunteers using an occlusive patch/chamber. The soaps are applied for 8 hours per day for 5 days, and the resultant damage to the skin is rated. In this testing the Neutrogena® transparent bar formula has been shown to be milder than the other bar soaps tested. In addition, this mildness has also been demonstrated in exaggerated use tests and antecubical wash test. (*Principle of Cosmetics for the Dermatologist.* Frost, P. and Horwitz, S., Chapter 1, pp 5–12, C. V. Mosby Company, 1982.)

Pape (U.S. Pat. No. 2,005,160) described a method for making milled transparent soap from a blend containing rosin but no alcohol or sugar. The process included "shock cooling", that is, reducing the temperature of the soap mass from 100° C. to 20° C. in 2 seconds.

Later, Kelly (U.S. Pat. No. 2,970,116; French Pat. No. 1,291,638; and U.K. Pat. No. 1,033,422) developed a process for making milled translucent soaps by mechanical working and milling at controlled temperatures and vacuum plodding. Though having obvious advantages over the older processes, Kelly's processes never achieved any wide scale use or success. The bars were translucent and did not achieve the transparency defined previously.

Kamer et al (U.S. Pat. No. 3,562,167) taught a batch process for making a transparent soap formulation containing specified nonionic surfactants. In addition, Lager was granted U.S. Pat. No. 3,969,259 for incorporating germicides such as 2,4,4'-trichloro-2'-hydroxydiphenyl ether (Irgasan DP 300) into transparent soap bars.

At this point in time, the production of transparent soaps worldwide remains a batch process; continuous production without serious aesthetic defects (i.e. loss of transparency) has not been obtained.

The economic desideratum still eludes the industry for, except as indicated, the production of transparent soap remains a batch by batch process and continual production without serious aesthetic defects has not been obtained.

The present invention is directed to a process for the continuous production of transparent soap while improving the economy of production, enhancing the volume and rate of production without sacrificing any of the clarity associated with batch produced bars. In addition, quality improvements, such as lighter color and greater perfume stability is obtained by this continuous process.

SUMMARY OF THE INVENTION

An improved composition and process for manufacture of transparent soap is described which is more efficient and economical than any heretofore obtainable. Specifically the present disclosure describes a continuous process for the saponification of a mild transparent soap which is quicker, more easily controlled, conserves energy and produces a more uniform product with lighter color and superior fragrance stability than heretofore obtainable.

More particularly, the present invention involves the delivery of one or more streams of stoichiometrically balanced ingredients into a heated mixing apparatus, stirring the blended ingredients for a period of time, and thereafter withdrawing the contents therefrom, placing the mixture into molds which are quickly chilled to complete the bar which is then available for packaging. In this manner, the present invention substantially obviates all of the problems which haunted previous efforts to continuously produce transparent soap.

Accordingly, it is a prime object of the present invention to provide new and useful compositions and processes which enable transparent soap to be produced continuously.

A further object of the present invention is to provide a novel process for the continuous and controllable production of transparent soap bars which equals or exceeds the quality of bars produced by similar batch processes.

Still another object of the present invention is to provide a novel process for the continuous production of transparent soap bars which provide substantial improvement in unit costs, enhances the volume of production and sacrifices neither clarity nor purity in the resulting bar.

A still further object of the present invention is to provide a new and improved process for producing transparent soap which provides a bar soap which fully equals the clarity, quality, mildness, purity and beauty heretofore obtainable only by batch processing.

A further object of the present invention is to provide a new and improved process for producing transparent soap bars which eliminates the need for cooling frames, extruders and cutters by utilizing direct molding and rapid cooling (−20° C. to 6° C.) in its continuous production system.

These and still further objects as shall hereinafter appear are fulfilled by the composition and process of the present invention in a remarkably unexpected fashion as will be readily discerned from a careful consideration of the following detailed description of exemplary embodiments thereof, especially when read in conjunction with the accompanying drawing in which like parts bear like numerals throughout the several views.

BRIEF DESCRIPTION OF DRAWING

In the drawing:

FIG. 1 is a flow diagram of a soap process embodying the present invention.

DESCRIPTION OF PREFERRED EMBODIMENTS

In the practice of the present invention, the novel composition hereof contains triethanolamine (TEA), sodium hydroxide, distilled water, oleic acid, stearic acid, glycerine, ricinoleic acid, coco fatty acids, tallow fatty acids and other minor ingredients such as fragrance, antioxidants, chelating agents, foam stabilizers, colors, germicides, etc.

More particularly, the composition hereof contains the following ingredients in the following ranges (expressed in weight percent):

| | RANGES | | |
|---|---|---|---|
| | Minimum W/W% | Optimum W/W% | Maximum W/W% |
| TEA | 27.0 | 32.5 | 38.0 |
| NaOH (50%) | 7.0 | 8.2 | 9.4 |
| DI-Water | 1.0 | 2.4 | 7.0 |
| Oleic Acid | 0.0 | 3.4 | 6.0 |
| Stearic Acid | 6.0 | 17.5 | 20.5 |
| Cocodiethanolamide (CDEA) | 0.0 | 1.5 | 4.0 |
| Glycerine | 0.0 | 11.0 | 25.0 |
| Antioxidant | 0.0 | .1 | .5 |
| Fragrance | 0.0 | 1.0 | 3.0 |
| Ricinoleic Acid | 1.0 | 4.8 | 6.0 |
| Coco Fatty Acid | 3.0 | 6.3 | 20.2 |
| Tallow Fatty Acid | 8.0 | 11.0 | 14.0 |

-continued

| RANGES | Minimum W/W% | Optimum W/W% | Maximum W/W% |
|---|---|---|---|
| Laneth-10-Acetate | 0.0 | 2.0 | 4.0 |
| Nonoxylnol-14/PEG-4-Octanoate | 0.0 | 1.0 | 2.0 |
| Triethanolamine Lauryl Sulfate | 0.0 | 8.0 | 10.0 |
| Acetylated Lanolin Alcohol | 0.0 | 2.0 | 4.0 |
| Witch Hazel | 0.0 | 1.0 | 3.0 |
| Lauroyl Sarcosine | 0.0 | 1.0 | 2.5 |
| Citric Acid | 0.0 | 1.0 | 2.0 |
| Gluconic Acid | 0.0 | 0.2 | 1.5 |
| Sodium Metabisulfite | 0.0 | 0.5 | 1.5 |
| 4-Chloro-2-(2,4 Dichloro-Phenoxy)phenol (Irgasan-300) | 0.0 | 0.5 | 2.0 |

In addition to the above-listed ingredients, or as alternatives therefor depending on the availability of the reagents and/or the secondary characteristics desired, the following ingredients represent materials which may be incorporated into the blend without diminishing any of the primary characteristics required. Thus, satisfactory results are obtained with the addition of an antioxidant such as tocopherol, tocopherol acetate, BHA, BHT, citric acid, sodium meta-bisulfite, succinic acid and the like; a chelating agent such as EDTA, DTPA and similar agents; commercial grades of triethanolamine (TEA), such as 85% TEA which can contain both the corresponding secondary and primary amines as impurities; surfactants and/or foam boosters selected from a wide group of anionic, amphoteric, nonionic, and certain cationic surfactants as exemplified by (but not limited to) oleyl betaine, cocamidopropyl betaine, lauramide, C12–C18 olefin sulfonate, sodium lauryl sulfate, sodium laureth sulfate, cetyltrimethyl ammonium chloride, sodium cocoyl isethionate, Tween 20–80, and the like; fatty acids such as hydrogenated tallow, isostearic acid, lauric acid, palmitic acid, neodecanoic acid, lanolin fatty acids, palm kernel fatty acids, palm oil fatty acids and the like; solvents such as diethanolamine, propylene glycol, hexylene, quadrol and the like; and miscellaneous additives such as polyethylene glycol, lanolin, PEG-20, hydrolyzed animal proteins, sorbitol and the like. It has also been found, when the exigencies of production require, that potassium hydroxide can be used as a suitable substitute for sodium hydroxide in the neutralization process.

The formulation as described above has the unexpected propensity, when introduced into and processed through the equipment shown in the flow diagram of FIG. 1, for substantially instant saponification, as will hereinafter appear, and produces a light colored soap having superior fragrance stability to that obtained by the batch process while achieving at least equivalent physical properties such as hardness, foaming, solubility and clarity.

Referring to FIG. 1, one practice of the present invention comprises dividing the aforesaid composition into a first and second blend of ingredients, one disposed in each of a first and second discrete tank 11,12. Each blend is thereafter pumped from tanks 11,12 by speed controlled pumps 13,14, respectively, into a mixing tank 15 surrounded by water jacket 16. Thereafter, the mixture of the first and second blends, whose relationship has been carefully controlled by individually regulating the speed of feed pumps 13,14 to create a stoichiometric balance thereof in mixing tank 15, is pumped by a third speed controlled pump 18 into a second mixing tank 19 which is also surrounded by water jacket 20. Additional specialized ingredients can be added to the formulation at this point of the process. In tank 19, the mixture receives additional mixing and is thereafter discharged through outlet 21 into suitable molds 22 for further handling as will be hereinafter described in detail.

A suitable water heater 23 is disposed adjacent water jacket 16 and supplies jacket 16 with inlet water heated to about 90° C. This water from jacket 16 is fed to jacket 20 via suitable piping 24 and the water from jacket 20 is withdrawn therefrom via suitable piping 25 through which it may be directed to a drain (not shown) or returned to the reservoir 26 of heater 23, whatever the exigencies of a particular installation may require.

Regardless of the blend, the soap bars produced hereby are formed by discharging the warmed (60° C.–85° C.) soap mixture into the bar molds which are thereafter processed in identical fashion which will now be described.

The filled molds 22 are preferably disposed upon a suitable conveyor system 28 which transports the molds 22 into a chiller 29 having a cooling medium of from about −30° to about 6° C. provided by refrigeration. The filled molds 22 are maintained in the cooling environment at this temperature for a period of from 5–45 minutes whereupon a transparent bar of acceptable hardness (circa 120+40), free of crystals and without discoloration is produced. (See: Examples XII and XIII, infra.) The hardness, as reported herein, is measured using a penetrometer (Penetrometer, Precision Scientific, Chicago, IL). It is measured as the depth in millimeters a needle with a 50 gram weight will penetrate the bar in a given time. The greater the penetration, the softer the soap bar. The finished bars are then removed from the molds and packaged in the usual way and are ready for market.

To further aid in the understanding of the present invention, and not by way of limitation, the following examples are presented.

EXAMPLE I

Transparent soap bars were prepared in accordance with the dual tank procedure of the present invention. The first tank was filled with Blend A and the second tank was filled with Blend B, both shown below. Each tank was preheated to 70°–80° C. and the contents were pumped therefrom in stoichiometric amounts into a mixing vessel surrounded by a hot water jacket wherein saponification occurs during agitation.

| BLEND A | |
|---|---|
| Triethanolamine (TEA) | 4.2 |
| Ricinoleic Acid | 4.8 |
| Coco Fatty Acid | 6.3 |
| Tallow Fatty Acid | 11.0 |
| Oleic Acid | 3.4 |
| Stearic Acid | 17.5 |
| CDEA | 1.8 |
| dl-α-Tocopherol | 0.10 |
| Fragrance | 1.0 |
| Total | 50.0 |
| **BLEND B** | |
| TEA | 28.4 |
| NaOH 50% | 8.2 |
| DI-Water | 2.4 |
| Glycerine | 11.0 |
| Total | 50.0 |

Thereafter the final mixture is withdrawn from the mixing tank into appropriate molds which are chilled in accordance with Example XII.

EXAMPLE II

Transparent soap bars were prepared in accordance with the dual tank procedure of the present invention. The first tank was filled with Blend C and the second tank was filled with Blend D, both as reported below. Each tank was preheated to 70°-80° C. and the contents were pumped therefrom in stoichiometric amounts into a mixing vessel surrounded by a hot water jacket wherein saponification occurs during agitation.

| | |
|---|---|
| BLEND C | |
| Ricinoleic Acid | 4.7 |
| Coco Fatty Acid | 6.3 |
| Tallow Fatty Acid | 11.0 |
| Oleic Acid | 3.4 |
| Stearic Acid | 17.5 |
| CDEA | 1.8 |
| dl-α-Tocopherol | 0.5 |
| Total | 45.2 |
| BLEND D | |
| TEA | 32.5 |
| NaOH 50% | 8.2 |
| DI-Water | 3.1 |
| Glycerine | 11.0 |
| Total | 54.8 |

Thereafter the final mixture is withdrawn from the mixing tank into appropriate molds which are chilled in accordance with Example XII.

EXAMPLE III

Transparent soap bars were prepared in accordance with the dual tank procedure of the present invention. The first tank was filled with Blend E and the second tank was filled with Blend F, both as reported below. Each tank was preheated to 70°-80° C. and the contents were pumped therefrom in stoichiometric amounts into a mixing vessel surrounded by a hot water jacket wherein saponification occurs during agitation.

| | |
|---|---|
| BLEND E | |
| Ricinoleic Acid | 4.8 |
| Coco Fatty Acid | 6.3 |
| Tallow Fatty Acid | 11.0 |
| Oleic Acid | 3.4 |
| Stearic Acid | 17.5 |
| CDEA | 1.8 |
| Glycerine | 11.0 |
| dl-α-Tocopherol | 0.05 |
| Total | 55.9 |
| BLEND F | |
| TEA | 32.5 |
| NaOH 50% | 8.2 |
| DI-Water | 3.4 |
| Total | 44.1 |

Thereafter the final mixture is withdrawn from the mixing tank into appropriate molds which are chilled in accordance with Example XII.

EXAMPLE IV

Transparent soap bars were prepared in accordance with the dual tank procedure of the present invention. The first tank was filled with Blend G and the second tank was filled with Blend H, both as reported below. Each tank was preheated to 70°-80° C. and the contents were pumped therefrom in stoichiometric amounts into a mixing vessel surrounded by a hot water jacket wherein saponification occurs during agitation.

| | |
|---|---|
| BLEND G | |
| Triethanolamine (TEA) | 33.3% |
| Ricinoleic Acid | 4.8 |
| Coco Fatty Acid | 6.3 |
| Tallow Fatty Acid | 11.0 |
| Oleic Acid | 3.4 |
| Stearic Acid | 17.5 |
| dl-α-Tocopherol | .1 |
| DI-Water | 3.4 |
| Glycerine | 12.0 |
| Total | 91.8 |
| BLEND H | |
| NaOH 50% | 8.2 |

Thereafter the final mixture is withdrawn from the mixing tank into appropriate molds which are chilled in accordance with Example XII.

EXAMPLE V

Transparent soap bars were prepared in accordance with the dual tank procedure of the present invention. The first tank was filled with Blend I and the second tank was filled with Blend J, both as reported below. Each tank was preheated to 70°-80° C. and the contents were pumped therefrom in stoichiometric amounts into a mixing vessel surrounded by a hot water jacket wherein saponification occurs during agitation.

| | |
|---|---|
| BLEND I | |
| Triethanolamine (TEA) | 32.5% |
| Ricinoleic Acid | 4.8 |
| Coco Fatty Acid | 6.3 |
| Tallow Fatty Acid | 11.0 |
| Oleic Acid | 3.4 |
| Stearic Acid | 17.5 |
| Lauric Diethanolamide | 1.0 |
| Glycerine | 11.8 |
| dl-α-Tocopherol | 0.1 |
| Total | 88.4 |
| BLEND J | |
| NaOH 50% | 8.2 |
| DI-Water | 3.4 |
| Total | 11.6 |

Thereafter the final mixture is withdrawn from the mixing tank into appropriate molds which are chilled in accordance with Example XII.

EXAMPLE VI

Transparent soap bars were prepared in accordance with the dual tank procedure of the present invention. The first tank was filled with Blend K and the second tank was filled with Blend L, both as reported below. Each tank was preheated to 70°-80° C. and the contents were pumped therefrom in stoichiometric amounts into a mixing vessel surrounded by a hot water jacket wherein saponification occurs during agitation.

| | |
|---|---|
| BLEND K | |
| Triethanolamine (TEA) | 34.3% |
| Ricinoleic Acid | 4.8 |
| Coco Fatty Acid | 6.3 |
| Tallow Fatty Acid | 11.0 |
| Oleic Acid | 3.4 |
| Stearic Acid | 17.5 |
| dl-α-Tocopherol | .1 |

-continued

| | |
|---|---|
| Total | 77.4 |
| BLEND L | |
| NaOH 50% | 8.2 |
| DI-Water | 3.4 |
| Glycerine | 11.0 |
| Total | 22.6 |

Thereafter the final mixture is withdrawn from the mixing tank into appropriate molds which are chilled in accordance with Example XII.

EXAMPLE VII

Transparent soap bars were prepared in accordance with the dual tank procedure of the present invention. The first tank was filled with Blend M and the second tank was filled with Blend N, both as reported below. Each tank was preheated to 70°-80° C. and the contents were pumped therefrom in stoichiometric amounts into a mixing vessel surrounded by a hot water jacket wherein saponification occurs during agitation.

| | |
|---|---|
| BLEND M | |
| Ricinoleic Acid | 4.8 |
| Coco Fatty Acid | 6.3 |
| Tallow Fatty Acid | 11.0 |
| Oleic Acid | 3.4 |
| Stearic Acid | 17.5 |
| CDEA | 3.6 |
| dl-α-Tocopherol | .1 |
| Total | 46.7 |
| BLEND N | |
| TEA | 31.7 |
| NaOH 50% | 8.2 |
| DI-Water | 3.4 |
| Glycerine | 10.0 |
| Total | 53.3 |

Thereafter the final mixture is withdrawn from the mixing tank into appropriate molds which are chilled in accordance with Example XII.

EXAMPLE VIII

Transparent soap bars were prepared in accordance with the dual tank procedure of the present invention. The first tank was filled with Blend O and the second tank was filled with Blend P, both as reported below. Each tank was preheated to 70°-80° C. and the contents were pumped therefrom in stoichiometric amounts into a mixing vessel surrounded by a hot water jacket wherein saponification occurs during agitation.

| | |
|---|---|
| BLEND O | |
| Triethanolamine (TEA) | 4.1% |
| Ricinoleic Acid | 4.8 |
| Coco Fatty Acid | 6.3 |
| Tallow Fatty Acid | 11.0 |
| Oleic Acid | 3.4 |
| Stearic Acid | 17.5 |
| CDEA | 1.8 |
| dl-α-Tocopherol | .1 |
| Total | 49.0 |
| BLEND P | |
| TEA | 28.4% |
| NaOH 50% | 8.2 |
| Glycerine | 11.0 |
| DI-Water | 3.4 |
| Total | 51.0 |

Thereafter the final mixture is withdrawn from the mixing tank into appropriate molds which are chilled in accordance with Example XII.

EXAMPLE IX

Transparent soap bars were prepared in accordance with the dual tank procedure of the present invention. The first tank was filled with Blend Q and the second tank was filled with Blend R, both as reported below. Each tank was preheated to 70°-80° C. and the contents were pumped therefrom in stoichiometric amounts into a mixing vessel surrounded by a hot water jacket wherein saponification occurs during agitation.

| | |
|---|---|
| BLEND Q | |
| Ricinoleic Acid | 4.8 |
| Coco Fatty Acid | 6.3 |
| Tallow Fatty Acid | 11.0 |
| Oleic Acid | 3.4 |
| Stearic Acid | 17.5 |
| CDEA | 1.8 |
| Glycerine | 11.0 |
| dl-α-Tocopherol | .1 |
| Total | 55.9 |
| BLEND R | |
| TEA | 32.5 |
| NaOH 50% | 8.2 |
| DI-Water | 3.4 |
| Total | 44.1 |

Thereafter the final mixture is withdrawn from the mixing tank into appropriate molds which are chilled in accordance with Example XII.

EXAMPLE X

Transparent soap bars were prepared in accordance with the dual tank procedure of the present invention. The first tank was filled with Blend S and the second tank was filled with Blend T, both as reported below. Each tank was preheated to 70°-80° C. and the contents were pumped therefrom in stoichiometric amounts into a mixing vessel surrounded by a hot water jacket wherein saponification occurs during agitation.

| | |
|---|---|
| BLEND S | |
| Triethanolamine (TEA) | 30.2% |
| Coco Fatty Acid | 20.2 |
| Stearic Acid | 20.2 |
| Glycerine | 12.1 |
| DI-Water | 7.0 |
| Citric Acid | 0.5 |
| Gluconic Acid | 0.2 |
| Sodium Metabisulfite | 0.5 |
| Total | 90.9 |
| BLEND T | |
| NaOH 50% | 9.1% |
| Total | 9.1 |

Thereafter the final mixture is withdrawn from the mixing tank into appropriate molds which are chilled in accordance with Example XII.

EXAMPLE XI

Transparent soap bars were prepared in accordance with the dual tank procedure of the present invention. The first tank was filled with Blend U and the second tank was filled with Blend V, both as reported below. Each tank was preheated to 70°-80° C. and the contents were pumped therefrom in stoichiometric amounts into a mixing vessel surrounded by a hot water jacket wherein saponification occurs during agitation.

| BLEND U | |
|---|---|
| Coco Fatty Acid | 20.2% |
| Stearic Acid | 20.2 |
| Citric Acid | .5 |
| Gluconic Acid | .2 |
| Sodium Metabisulfite | .5 |
| Total | 41.6 |
| BLEND V | |
| NaOH 50% | 9.1 |
| DI-Water | 7.0% |
| Glycerine | 12.1 |
| Triethanolamine (TEA) | 30.2 |
| Total | 58.4 |

Thereafter the final mixture is withdrawn from the mixing tank into appropriate molds which are chilled in accordance with Example XII.

EXAMPLE XII

One hundred grams of the hot soap mixture prepared according to the procedure described in Example I, was poured at 85° C. into plastic soap molds and subjected to rapid cooling in a variety of controllable media. The internal temperature of the bars was monitored until it reached 25° C. at which time the bar was removed from the cooling medium and tested for color, clarity, stability and hardness.

The results are shown in Table A below. Surprisingly, there was no adverse effect on any of the properties of the resultant bars with the exception of hardness at very low temperature $<-50°$ C. Color, clarity, stability and chemical properties all compared favorably with the conventionally prepared transparent soap bars.

TABLE A

| Cooling Medium | T °C. | (min) | Hardness (mm) | Color | Clarity |
|---|---|---|---|---|---|
| Dry ice/Alcohol | −50 | 15 | 275 | 43.4 | OK |
| Freezer | −20 | 27 | 194 | 42.2 | OK |
| Refrigerator | 5 | 35 | 149 | 41.6 | OK |
| Ambient | 25 | 120 | 132 | 40.4 | OK |

Color is recorded as the "L" lightness value, as measured by a Macbeth Colorimeter, Model 1500, Macbeth, Inc., New York, NY.

EXAMPLE XIII

In further cooling experiments, a PVC soap mold (8.0 cm×5.0 cm×2.5 cm) containing 100 g of molten soap (80° C.) from Example I, was drawn through a cooling tunnel (8.5 ft in length and 5.5 inch diameter) with an average temperature of 0° to 4° C. In these experiments, the molds were drawn through the cooling tunnel at various rates, and the physical properties determined as in Example XII.

TABLE B

| Time | Bar Temp. (°C.) | Initial Hardness (mm) | Final Hardness (mm) |
|---|---|---|---|
| 5 min | 53.3 | — | 134 |
| 7 min | 47.2 | — | 154 |
| 9 min | 42.6 | — | 122 |
| 11 min | 39.2 | — | 126 |
| 13 min | 36.1 | 820 | 138 |
| 15 min | 33.1 | 420 | 142 |
| 17 min | 30.4 | 338 | 130 |
| 19 min | 28.4 | 272 | 132 |
| 12 Hrs. (Control) | 22.4 | 126 | 130 |

TABLE B-continued

| Time | Color | Clarity | Stability |
|---|---|---|---|
| 5 min | 44.2 | OK | OK |
| 7 min | 44.6 | OK | OK |
| 9 min | 44.5 | OK | OK |
| 11 min | 44.7 | OK | OK |
| 13 min | 43.9 | OK | OK |
| 15 min | 44.2 | OK | OK |
| 17 min | 44.2 | OK | OK |
| 19 min | 44.1 | OK | OK |
| 12 Hrs. (Control) | 43.8 | OK | OK |

In this experiment, it was found that after 15 to 17 minutes of cooling, the resultant bar was sufficiently solidified to allow handling and initial hardness measurements. In addition, the hardness of these bars was again determined after 12 hours at room temperature (Final Hardness). No significant difference was found between the final hardness of the rapidly cooled bars, and that of the control bars which were cooled at room temperature in a metal frame for 12 hours (720 min). No significant changes in color, clarity, stability, or texture were found in the rapidly cooled bars.

EXAMPLE XIV

In a further series of experiments, the basic formula shown in Example I was made 3 times (Experiments 4, 5 and 6) using the continuous process, and compared to 3 batches (Experiments 1, 2 and 3) made using the same formula (Example I) but prepared using a batch process. In the batch process, the triethanolamine (50% of the total TEA), ricinoleic acid, coco fatty acid, and tallow fatty acids are mixed with the caustic soda and heated at 90°-96° C. for 30 minutes. After the 30 minute heating, additional triethanolamine is added and the batch cooled to 85° C., followed by the addition of oleic acid, stearic acid, cocodiethanolamine (CDEA) and glycerine. After the addition of these ingredients, other minor ingredients such as antioxidants, fragrances etc, are added. The soap is then poured into frames or molds and allowed to cool. The resultant soaps were compared for color, appearance, hardness, pH, foaming and stability.

TABLE C

| Experiment | Process | Color | Hardness (mm) | pH | Foam | Stability |
|---|---|---|---|---|---|---|
| 1 | Batch | 35.97 | 138 | 9.0 | 295 | OK |
| 2 | Batch | 36.55 | 148 | 9.0 | 300 | OK |
| 3 | Batch | 35.90 | 124 | 8.9 | 295 | OK |
| 4 | Continuous | 43.10 | 130 | 8.9 | 300 | OK |
| 5 | Continuous | 42.70 | 138 | 9.0 | 295 | OK |
| 6 | Continuous | 43.30 | 120 | 8.9 | 300 | OK |

Foam Test results are listed as ml of foam produced, by shaking 50 ml of a 1.0% soap solution with 199 ml of tap water (120 ppm of hardness) and 1.0 ml olive oil in a stoppered volumetric flask. The mixture is inverted 10 times in 25 seconds, and the foam height produced, is measured.

EXAMPLES XV-XXIX

The two-phase procedure of Example I was repeated using the apparatus of FIG. 1 and the blends reported in Table B below. In every case, transparent soap bars having the improved characteristics of the present invention were produced.

TABLE B-1

| INGREDIENTS | EXAMPLES | | | |
|---|---|---|---|---|
| PHASE I | XV | XVI | XVII | XVIII |
| Triethanolamine | 33.5 | 33.8 | 27 | 38 |
| Caustic Soda 50% | 8.4 | 8.5 | 8.4 | 8.4 |
| Water | 4.1 | 4.1 | 4.1 | 4.1 |
| Glycerine | 10.2 | 10.4 | 17 | 5 |
| PHASE II | | | | |
| Ricinoleic Acid | 4.8 | 4.8 | 4.8 | 4.8 |
| Coco Fatty Acid | 5.9 | 6 | 5.9 | 5.9 |
| Tallow Fatty Acid | 11.2 | 11.3 | 11 | 11.2 |
| Oleic Acid | 3.5 | 0 | 3.5 | 3.5 |
| Stearic Acid | 17.9 | 18.1 | 17.1 | 17.9 |
| CDEA | 0 | 1.9 | 1 | 0.7 |
| Antioxidant | 0.5 | 0.5 | 0.2 | 0.5 |
| Fragrance | | 0.6 | | |
| TOTAL | 100 | 100 | 100 | 100 |
| PHASE I | XIX | XX | XXI | XXII |
| Triethanolamine | 33.6 | 37 | 30.6 | 30 |
| Caustic Soda 50% | 8.2 | 9.4 | 7.4 | 8.2 |
| Water | 1 | 5 | 3 | 2 |
| Glycerine | 15 | 0 | 11 | 25 |
| PHASE II | | | | |
| Ricinoleic Acid | 3.5 | 6 | 6 | 4.4 |
| Coco Fatty Acid | 3 | 8.6 | 7 | 4.4 |
| Tallow Fatty Acid | 11 | 9 | 8 | 14 |
| Oleic Acid | 3.4 | 5 | 6 | 4 |
| Stearic Acid | 19 | 16.7 | 20.5 | 6 |
| CDEA | 1.8 | 1.8 | 0 | 2 |
| Antioxidant | 0.5 | 0.5 | 0.5 | 0 |
| Fragrance | | | | |
| TOTAL | 100 | 100 | 100 | 100 |
| PHASE I | XXIII | XXIV | XXV | XXVI |
| Triethanolamine | 32.5 | 30.2 | 30.2 | 30.5 |
| Caustic Soda 50% | 8.2 | 9.1 | 9.1 | 8.1 |
| Water | 2 | 6.8 | 7 | 3.5 |
| Glycerine | 11 | 12.1 | 12.1 | 9.4 |
| PHASE II | | | | |
| Ricinoleic Acid | 4.7 | 0 | 0 | 4.6 |
| Coco Fatty Acid | 6.3 | 20.2 | 20.2 | 5.6 |
| Tallow Fatty Acid | 11 | — | — | 10.5 |
| Oleic Acid | 3 | — | — | 3.3 |
| Stearic Acid | 16.8 | 18.9 | 18.9 | 16.5 |
| CDEA | 4 | — | — | 1.5 |
| Citric Acid | | 1 | 1 | |
| Gluconic Acid | | 0.2 | 1 | |
| Sodium Metabisulfite | | 1.5 | 0.5 | |
| Laneth-10-Acetate | | | | 4 |
| Nonoxynol-14/PEG-4-Octanoate | | | | 2 |
| Antioxidant | 0.5 | | | 0.5 |
| Fragrance | | | | |
| TOTAL | 100 | 100 | 100 | 100 |
| PHASE I | | XXVII | XXVIII | XXIX |
| Triethanolamine | | 28.5 | 30.5 | 32 |
| Caustic Soda 50% | | 7.7 | 8.1 | 8.2 |
| Water | | 3.1 | 3.5 | 3 |
| Glycerine | | 8 | 9.5 | 10 |
| PHASE II | | | | |
| Ricinoleic Acid | | 4.4 | 4.6 | 4.6 |
| Coco Fatty Acid | | 5.4 | 5.6 | 6.1 |
| Tallow Fatty Acid | | 9.2 | 10.5 | 10.5 |
| Oleic Acid | | 3 | 3.3 | 3.3 |
| Stearic Acid | | 14.7 | 16.5 | 17.5 |
| CDEA | | 1.5 | 1.5 | 1.5 |
| Citric Acid | | | | |
| Gluconic Acid | | | | |
| Sodium Metabisulfite | | | | |
| Laneth-10-Acetate | | | | |
| Nonoxynol-14/PEG-4-Octanoate | | | | |
| TEA-Lauryl Sulfate | | 10 | | |
| Acetylated Lanolin Alcohol | | 4 | | |
| Witch Hazel | | | 3 | |
| Lauroyl Sarcosine | | | 2.5 | |
| Antioxidant | | 0.5 | 0.5 | 0.3 |
| Fragrance | | | 0.4 | 3 |
| TOTAL | | 100 | 100 | 100 |

From the foregoing, it is apparent that there are several important features associated with the practice of the present invention. Thus a process is herein described and illustrated which obtains the production of transparent soap on a continuous basis which soap has improved color, improved fragrance, stability and more uniform quality than was heretofor obtainable by existing batch procedures.

In addition to the foregoing, the process of the present invention provides significant economic advantages in reduced processing time and lower labor costs while the composition/process interaction enables rapid cooling from 80° C. to 30° C. without affecting the basic characteristics of such soap, namely, hardness, solubility, clarity and foaming.

It is apparent that the compositions and processes herein described and illustrated fulfill all of the foregoing objectives in a remarkably unexpected fashion. It is of course understood that such modifications, alterations and adaptations, as may readily occur to the artisan skilled in the art to which this disclosure pertains as included within the spirit of this invention which is limited only by the scope of the claims appended hereto.

Accordingly,

What is claimed is:

1. A process for continuously saponifying a transparent soap mixture and continuously producing transparent soap bars therefrom comprising: introducing a first blend of soap-making reagents containing cocofatty acid, stearic acid, and cocodiethanolamide but no NaOH 50% into a first storage tank; introducing a second blend of soap-making reagents containing NaOH 50% but no cocofatty acid, stearic acid or cocodiethanolamide into a second storage tank; independently pumping said first blend from said first storage tank and said second blend from said second storage tank continuously into a first heated mixing tank, each being pumped at a rate predetermined to create a stoichiometrically balanced mixture between said first blend and said second blend in said first mixing tank to initiate the saponification of said mixture therewithin; continuously transferring stoichiometrically balanced mixture from said first mixing tank into a second heated mixing tank with stirring at a rate to complete the saponification thereof in said second mixing tank; continuously pumping said completely saponified mixture from said second mixing tank into bar molds to fill said molds; introducing said filled molds into a chilled environment to quickly cool and solidify said mixture into solidified bars without impairing the transparency thereof; removing the chilled molds containing the solidified bars from said chilled environment; separating the solidified bars from the chilled molds; recycling said molds to said second mixing tank for refilling; and packaging said bars.

2. A continuous process according to claim 1 in which either said first blend or said second blend contain as additional ingredients therein one or more ingredients selected from the group consisting of: fragrances, antioxidants, chelating agents, foam stabilizers, colors and germicides.

3. A continuous process according to claim 1 in which said chilled environment is controlled at a temperature from about −30° C. up to about +30° C.

4. A continuous process according to claim 2 in which said chilled environment is controlled at a temperature from about −30° C. up to about +30° C.

5. A continuous process according to claim 1 in which said mixture is cooled from 85° C. to 25° C. in about twenty minutes.

6. A continuous process according to claim 2 in which said mixture is cooled from 85° C. to 25° C. in about twenty minutes.

7. A continuous process for producing a transparent soap containing (in weight percent): from 27.0 to 38.0, triethanolamine; from 7.0 to 9.4, NaOH; from 1.0 to 7.0, deionized water; from 6.0 to 20.5, stearic acid; from 5.0 to 25.0, glycerine; and from 4.0 to 20.2, coco fatty acid, said process comprising dividing said ingredients into at least two separate blends in which one contains the NaOH and another contains the stearic acid and the coco fatty acid and the remaining ingredients are disposed in either blend, introducing a first blend into a first tank and a second blend into a second tank; independently pumping said first and said second blend in a first heated mixing tank at a rate predetermined to create a stoichiometric balanced mixture within said first mixing tank to initiate the saponification thereof; transferring said stoichiometrically balanced mixture into a second heated mixing tank while stirring to complete the saponification thereof; pumping said completely saponified balanced mixture from said mixing tank into bar molds to fill said molds; introducing said filled molds into a chilled environment to cool and solidify said mixture; removing said molds from said chilled environment; removing the solidified bars of soap from said molds; and packaging said bars.

8. A continuous process according to claim 7 in which said mixture is cooled from 85° C. to 25° C. in about twenty minutes.

* * * * *